US005273708A

United States Patent [19]

Freeman

[11] Patent Number: 5,273,708

[45] Date of Patent: Dec. 28, 1993

[54] METHOD OF MAKING A DUAL ALLOY ARTICLE

[75] Inventor: William R. Freeman, Easton, Conn.

[73] Assignee: Howmet Corporation, Greenwich, Conn.

[21] Appl. No.: 904,193

[22] Filed: Jun. 23, 1992

[51] Int. Cl.[5] ..... B22F 1/02

[52] U.S. Cl. ..... 419/35; 419/36; 419/37; 419/42; 419/49; 428/544

[58] Field of Search ..... 419/35, 36, 37, 42, 419/49; 428/544

[56] References Cited

U.S. PATENT DOCUMENTS

| | | | |
|---|---|---|---|
| 3,376,915 | 4/1968 | Chandley | 164/51 |
| 3,494,709 | 2/1970 | Piearcey | 416/232 |
| 3,536,121 | 10/1970 | Piearcey | 164/60 |
| 3,542,120 | 11/1970 | Piearcey | 164/361 |
| 3,627,015 | 12/1971 | Giamei et al. | 164/60 |
| 3,690,368 | 9/1972 | Copley et al. | 164/350 |
| 3,839,618 | 10/1974 | Muehlberger | 219/121 P |
| 4,008,052 | 2/1977 | Vishnevsky et al. | 29/194 |
| 4,096,615 | 6/1978 | Cross | 29/156.8 R |
| 4,186,473 | 2/1980 | Cross et al. | 29/156.8 R |
| 4,240,495 | 12/1980 | Vonnegut | 164/125 |
| 4,270,256 | 6/1981 | Ewing | 29/156.8 R |
| 4,335,997 | 6/1982 | Ewing et al. | 416/185 |
| 4,381,931 | 5/1983 | Hunold et al. | 65/18.1 |
| 4,418,124 | 11/1983 | Jackson et al. | 428/548 |
| 4,445,259 | 5/1984 | Ekbom | 29/156.8 B |
| 4,447,466 | 5/1984 | Jackson et al. | 427/34 |
| 4,528,120 | 7/1985 | Hunold et al. | 252/516 |
| 4,529,452 | 7/1985 | Walker | 148/11.5 Q |
| 4,538,331 | 9/1985 | Egan et al. | 29/156.8 R |
| 4,562,090 | 12/1985 | Dickson et al. | 427/34 |
| 4,573,876 | 3/1986 | Egan et al. | 416/213 R |
| 4,581,300 | 4/1986 | Hoppin, III et al. | 428/546 |
| 4,592,120 | 6/1986 | Egan et al. | 29/156.8 R |
| 4,596,718 | 6/1986 | Gruner | 427/34 |
| 4,659,288 | 4/1987 | Clark et al. | 416/186 R |
| 4,705,203 | 11/1987 | McComas et al. | 228/119 |
| 4,735,656 | 4/1988 | Schaefer et al. | 75/238 |
| 4,832,112 | 5/1989 | Brinegar et al. | 164/499 |
| 4,878,953 | 11/1989 | Saltzman et al. | 148/4 |
| 4,961,778 | 10/1990 | Pyzik et al. | 75/230 |
| 4,966,748 | 10/1990 | Miyasaka et al. | 419/8 |
| 4,980,123 | 12/1990 | Gedeon et al. | 419/8 |
| 5,059,387 | 10/1991 | Brasel | 419/23 |

OTHER PUBLICATIONS

"Vacuum Plasma Sprayed Metallic Coatings", S. Shankar, D. E. Koenig and L. E. Dardi; Oct., 1981; pp. 13-20.

*Primary Examiner*—Peter A. Nelson

*Attorney, Agent, or Firm*—Flynn, Thiel, Boutell & Tanis

[57] ABSTRACT

In making a dual alloy gas turbine rotor, a plurality of superalloy components are formed to include an airfoil having a directionally solidified columnar grain structure or a single crystal grain structure. A boron-bearing melting point depressant material is applied to the inner surface and a side surface of the components. The components are arranged side-by-side in an annular array with the first side surface of one component juxtaposed to the second side surface of an adjacent component and with the inner surfaces defining a spray-receiving surface. The airfoils extend in a radial axis or direction of the array while the spray-receiving surface extends in a circumferential direction of the article. A sealing member is positioned adjacent an axial end of the array of the components to close off that end and form a spray-receiving cavity. Boron-bearing melting point depressant material is provided between the sealing member and the end of the array. The array/sealing member is heated to form an exposed liquid layer on the spray-receiving surface at the onset of plasma spraying of a molten metal and also to form a fusion joint between the juxtaposed first and second surfaces of the components and between the sealing member and the end of the array. A superalloy hub material is plasma sprayed onto the exposed liquid layer to buildup up a deposit in the cavity that forms a hub precursor of the rotor. The array/deposit is hot isostatically pressed using pressurized gas and then heated treated to develop desired properties in the components and the hub precursor.

23 Claims, 2 Drawing Sheets

Fig-1
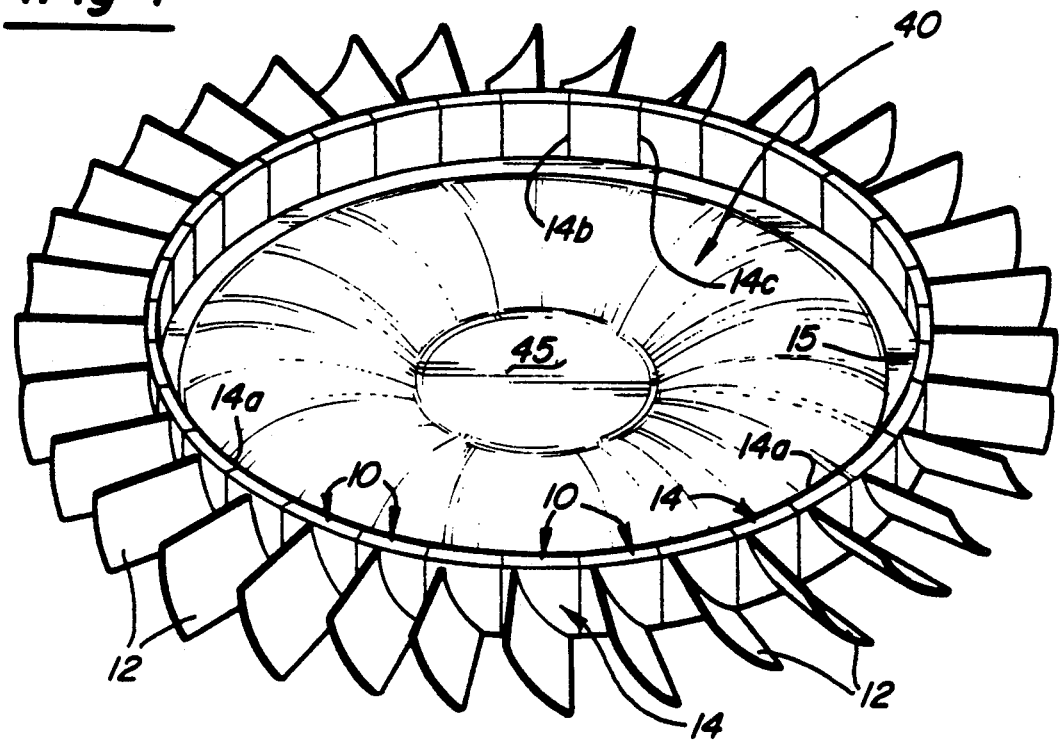
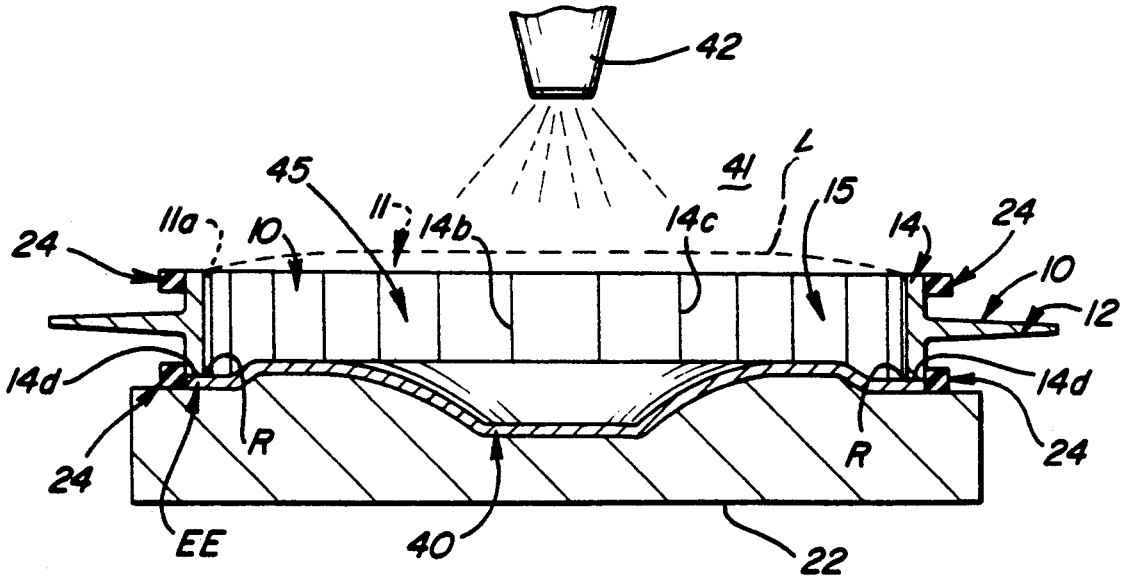
Fig-2

METHOD OF MAKING A DUAL ALLOY ARTICLE

FIELD OF THE INVENTION

The present invention relates to a method of making a dual alloy article, such as a bladed turbine wheel, blisk and the like.

BACKGROUND OF THE INVENTION

Compressor and turbine rotors (or wheels) as well as centrifugal impellers used in gas turbine engines represent load bearing components which would have an equiaxed fine grain microstructure in the hub-to-rim regions for optimum low cycle fatigue resistance at service temperature and an equiaxed cast grain, directionally solidified columnar grain, or single crystal structure in the blades for optimum high temperature stress rupture strength at service temperature.

Although integrally cast bladed turbine rotors have been successfully used for years in many small turbine engine applications, the prior art has recognized that the conventional investment cast rotor inherently compromises the ideal microstructure described in the preceding paragraph. Namely, the relatively massive hub section of the casting exhibits a coarse, columnar grain structure due to its slower solidification and cooling after casting, while the rim section may exhibit a finer, columnar grain structure. As a result of their thin section, the integrally cast blades exhibit a generally equiaxed, finer grain structure sometimes including columnar grains with an unsatisfactory orientation. The significance of such a compromise in the microstructure of the turbine rotor becomes apparent when it is recognized that the mechanical properties of the casting are a function of the number and orientation of the grains in the particular region of interest. For example, coarser grain structures are known to offer better elevated temperature stress rupture properties than a fine grain structure. However, the latter grain structure offers better low cycle fatigue properties. Moreover, the low cycle fatigue properties within a cast component depend on the crystallographic orientation of grains relative to the local distribution of stress(es). An unfavorably oriented coarse, columnar grain in a conventionally cast component can contribute to premature failure of the component.

An improved investment casting process, known as the Grainex® investment casting process, was developed to enhance the uniformity of the microstructure of integrally cast bladed rotors (specifically integral turbine wheels) to meet new challenges of component performance and reliability demanded by increased thrust and horsepower applications. The Grainex process includes motion of the mold during solidification of the melt and also, a post-casting HIP (hot isostatic pressing) treatment. This process develops a substantially uniform fine, equiaxed grain structure through the hub, web and rim regions of the casting. This microstructure provides a significant improvement in consistency in the low cycle fatigue properties in these sections of the cast turbine wheel while providing stress rupture properties in the blades similar to those obtainable in conventionally investment cast integrally bladed rotors.

Another improved investment casting process, known as the MX® investment casting process, also was developed to enhance the uniformity of the microstructure of castings. The MX process involves filling a properly heated mold with molten metal having little superheat (e.g., within 20° F. of its measured melting temperature) and then solidifying the molten metal in the mold at a rate to form a casting having a substantially equiaxed cellular, non-dendritic microstructure uniformly throughout with attendant improvement in the mechanical properties of the casting. U.S. Pat. No. 4,832,112 describes this process.

Integrally bladed rotors also have been fabricated by machining processes which utilize either ingot or consolidated metal powder starting stock. The powder metal rotors are generally consolidated by hot isostatic processing (HIP) and demonstrate reduced alloy segregation compared to ingot metallurgy. Powder metal rotors are, however, susceptible to thermally induced porosity (TIP) from residual argon used in powder atomization. Any oxygen contamination of powders can form an oxide network resulting in metallographically detectable prior particle boundaries which are known sites of fracture initiation. These limitations make manufacture of rotors by machining of ingot or consolidated metal powder costly in terms of both processing and quality controls.

Advanced powder metal manufacturing and consolidating techniques coupled with advanced forging processes have provided the capability to produce fine grain rotors which exhibit improved low cycle fatigue properties as compared to conventional investment cast rotors. However, the forged rotors typically exhibit inferior stress rupture properties in the rim compared to conventional investment cast rotors.

Unfortunately, in general, metallurgical processing to maximize low cycle fatigue properties of a metal results in reduced creep (stress rupture) properties. As a result, in more demanding service applications where increased thrust and horsepower are required (e.g., in military aircraft), designers have often resorted to the traditional separately bladed/mechanical attachment approach that involves fabricating a fine-grained, forged disk; machining serrated slots in the disk to accept machined blade roots; and inserting cast blades of the desired grain structure (e.g., directionally oriented or single crystal) into the slots. However, machining slots and blade roots are costly processing steps. This method also limits the number of blades that can be attached, especially in smaller engines. A design with a large number of blades often is desirable for higher performance.

Those skilled in the art of turbine engine design have recognized the potential advantages of combining the ease of fabrication and the structural integrity of monolithic integrally cast/forged rotors with the high performance capability obtainable in separately bladed turbine engine rotors. Several approaches have been developed to produce such a turbine rotor. One such approach is illustrated in U.S. Pat. No. 4,096,615 wherein an equiaxed blade ring is cast and then solid state diffusion bonded to a separately produced powder metal hub or disk in a hot isostatic pressing step. Both an interference fit and braze sealing usually are required to achieve complete bonding during HIP'ing. In particular, a radially inwardly facing surface of the blade ring is machined to precise diameter to form a bonding surface adapted to mate with the radially outwardly facing bonding surface of a hub or disk made of another material. The blade ring is positioned over the hub and oxygen and other contaminants are removed from the bonding surfaces by vacuum treatment, followed by braze sealing the external joint lines with braze material. Hot isostatic pressing then is used to diffusion bond the blade ring to the hub. This approach has the disadvantage of requiring several separate processes: (1casting the blade ring; (2) precision machining the inner diameter of the blade ring; (3) powder metal HIP consolidation; (4) precision machining the outer diameter of the powder metal hub, (5) assembly of the blade ring and powder metal hub; and (6) a second HIP operation to achieve final solid state diffusion bonding. Each of these processes is expensive and may create additional costs arising from defect scrap losses. Moreover, the braze sealing operation has the potential to seep braze alloy into any gap at the interface and cause a localized embrittlement or weakness in the joint.

U.S. Pat. No. 4,270,256 describes a somewhat similar process for making a hybrid turbine rotor wherein an expendable blade fixturing ring is used to position the blades for bonding directly to a hub in a hot isostatic pressing step. The blade fixturing ring is removed after the blades are bonded to the hub.

A similar, complex approach for manufacturing a dual-alloy integrally bladed rotor is illustrated in U.S. Pat. No. 4,529,452. In that approach, a blade ring is formed by diffusion bonding a plurality of single crystal elements together. The bonded blade ring is then bonded to a hub by a superplastic forming/solid state diffusion bonding step.

Another approach used in the art employs powder metal in an investment mold which has directionally solidified or single crystal cast blades positioned within it. The mold is loaded in a metal can, covered with an inert pressure-transmitting media, vacuum sealed and hot isostatically pressed. This combined blade/powder metal approach has less process steps than the interference fit approach described immediately above but is severely limited in dimensional control due to blade/-mold movement during subsequent consolidation of the 65–70% dense powder.

A relatively new low pressure, high velocity plasma spray method to produce fine grain, load-bearing structural components (as opposed to protective coatings on a component) is illustrated in U.S. Pat. Nos. 4,418,124 and 4,447,466. This low pressure, high velocity plasma spray method to produce structural components employs a spraying procedure described in U.S. Pat. No. 3,839,618. Attempts have been made to use the low pressure, high velocity plasma spray technique to fabricate dual alloy turbine wheels. In these attempts, a plasma gun in a dynamic partial vacuum (low pressure) is used to plasma spray molten metal onto a solid metal substrate in the form of an integrally bladed dish-shaped member. In particular, metal powder feedstock is injected into the plasma gun and propelled to the substrate in a carrier gas. A plasma jet deposits molten droplets of the spray cast metal on the surface of the solid substrate where the droplets solidify incrementally until the desired structural shape (e.g., a rotor hub preform) is obtained. The droplets are deposited by line-of-sight to produce simple near-net-shape configurations with a joint between the initial solid substrate (e.g., investment cast substrate) and the spray cast metal deposit. The spray cast deposit can be different in composition and/or microstructure from the initial solid substrate. After deposition of the spray cast metal, the preform is hot isostatically pressed (i.e., HIP'ed) to substantially eliminate voids primarily in the spray cast metal and perfect bond the spray cast metal and solid substrate at the bond joint therebetween.

It is an object of the invention to provide a method of making a dual alloy article wherein a plurality of individual components, such as airfoils, having a directionally oriented (solidified) or single crystal grain structure are joined together in a manner to form a ring/container into which molten metal is plasma sprayed to form a dual alloy article that is amenable for subsequent hot isostatic compaction.

SUMMARY OF THE INVENTION

The present invention contemplates a method of making a dual property article comprising forming a plurality of metallic components each having an inner surface and first and second side surfaces. The components are formed to exhibit desired grain structure and mechanical properties under the service conditions to be encountered by the article. The components are arranged side-by-side in an annular array with the first side surface of one component juxtaposed to the second side surface of an adjacent component and with the inner surfaces defining a spray-receiving surface. A melting point depressant material (e.g., boron, silicon, etc.) is provided on the inner surface and between juxtaposed first and second side surfaces of the components. The array of components is then heated to form an exposed liquid layer on the spray-receiving surface and a gas tight fusion joint between the juxtaposed first and second surfaces of the components. Molten metal is plasma sprayed onto the exposed liquid layer to build-up a spray cast deposit followed by hot isostatically pressing the array/deposit using pressurized gas. The resultant article includes the components bonded together and to the spray cast metal with the components exhibiting mechanical properties appropriate for their location on the article and the spray cast deposit exhibiting different mechanical properties appropriate for its location on the article.

A removable sealing member may be positioned adjacent an axial end of the array of the components with a melting point depressant material provided between the sealing member and the axial end of the array, whereby a gas tight fusion joint is effected between the sealing member and the axial end of the array during heating of the array preparatory to plasma spraying. The sealing member closes off the axial end of the array to form a chamber or cavity for receiving the plasma sprayed molten metal. The sealing member is removed after the hot isostatic pressing step.

In one embodiment of the invention, the individual components are formed to have a directionally solidified grain structure comprising columnar grains and are arranged so that the columnar grains extend along a radial axis of the article.

In another embodiment of the invention, the individual components are cast to have a single crystal grain structure and are arranged so that a given crystallographic axis of the single crystal grain structure extends along a radial axis of the article.

In another embodiment of the invention, the individual components are held by fixturing means in the array during the heating step preparatory to plasma spraying.

In still another embodiment of the invention, the individual components have a composition that is different from the composition of the plasma spray metal so as to form a dual alloy article.

In a particular embodiment of the invention for making a dual alloy gas turbine rotor, a plurality of superalloy components are formed to include an airfoil having a directionally solidified columnar grain structure or a single crystal grain structure. A boron-bearing melting point depressant material is applied to the inner surface and one of the first and second side surfaces of the components. The components are arranged side-by-side in an annular array with the first side surface of one component juxtaposed to the second side surface of an adjacent component and with the inner surfaces substantially contiguous to define a spray-receiving surface. The airfoils extend in a radial axis or direction of the array while the spray-receiving surface extends in a circumferential direction of the article. A removable sealing member is positioned adjacent an axial end of the array of the components to close off that end and form a cavity. Boron-bearing melting point depressant material is provided between the sealing member and the end of the array.

The array/sealing member is heated to form an exposed liquid layer on the spray-receiving surface at the onset of plasma spraying of a molten metal and also to fusion bond the juxtaposed first and second surfaces of the components and fusion bond the sealing member and the end of the array. Another superalloy is plasma sprayed onto the exposed liquid layer to build-up a deposit in the cavity that forms a hub precursor of the rotor. The array/deposit is hot isostatically pressed using pressurized gas and then optionally heated treated to develop desired properties in the components and the hub precursor.

The invention may be understood when considered in light of the following detailed description of certain embodiments thereof which are set forth hereafter in conjunction with the following drawings.

DESCRIPTION OF THE DRAWINGS

FIG. 1 is a perspective view of a plurality of airfoil-shaped superalloy components arranged in an annular array.

FIG. 2 is a sectional view of the array of components after a sealing member is cooperatively positioned adjacent one side of the array to close off that side and form a cavity for receiving a plasma spray case deposit. A plasma spray nozzle or gun is shown schematically for spraying molten metal into the cavity.

DETAILED DESCRIPTION OF THE INVENTION

Figure 3:
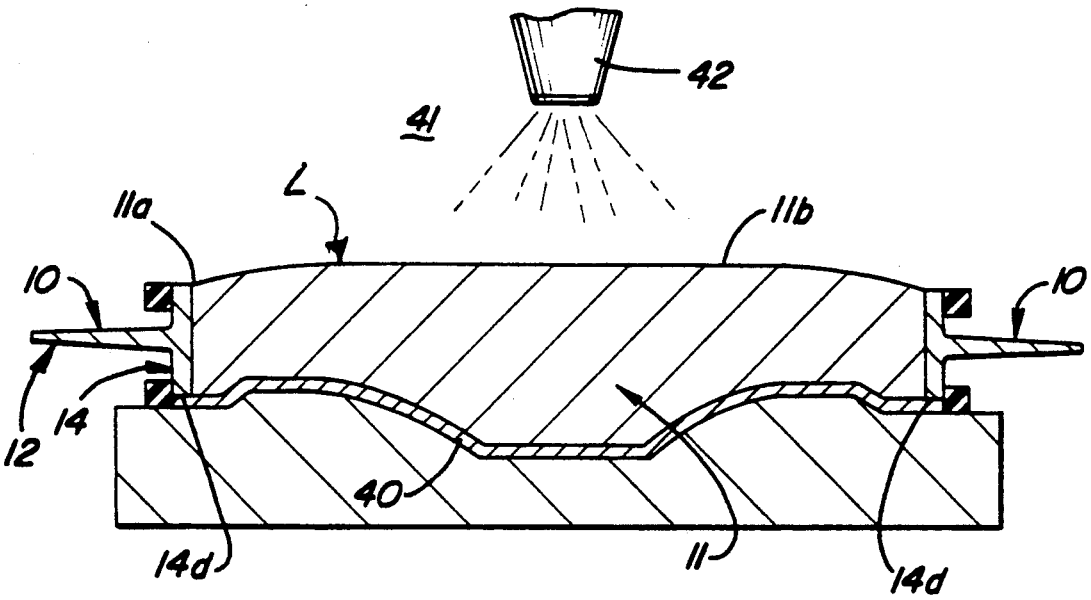
FIG. 3 is a view similar to FIG. 2 after the spray cast deposit is formed.

The present invention relates to a method of making a structural, dual-property article by plasma spraying molten metal onto a substrate using low pressure, high velocity plasma spraying procedures similar to those described in U.S. Pat. Nos. 3,839,618; 4,418,124; and 4,447,466. The method finds particular utility in making structural, dual-property articles for use at high temperature and can be used to form metal articles having different microstructures at different locations. For example, a dual property turbine wheel, blisk or rotor (all collectively referred to hereafter as a turbine rotor) having a fine grained hub and directionally solidified (columnar grain) or single crystal (single grain) blades can be fabricated in accordance with the invention.

Although the detailed description set forth below is directed to manufacture of dual-property turbine rotors, the invention is not so limited and may be practiced in the manufacture of myriad other structural, dual-property articles. Moreover, although the detailed description refers to nickelbase superalloys, the invention is not so limited and is operable with other superalloys as well as other metal and alloy systems that are capable of being formed into a molten metal spray and solidified to form a structural article that can have useful properties imparted thereto through appropriate thermal treatments.

In accordance with one embodiment of the present invention, a plurality of superalloy blade components 10 are formed to include an elongated airfoil 12 and a root or platform 14. The root 14 includes an inner arcuate surface **14*a* that typically extends in a circumferential direction and first and second side surfaces 14*b*,14*c* that typically extend in a radial direction. The individual components 10 are formed to impart to the airfoil 12** a desired metallurgical grain structure and mechanical properties for the service conditions to be encountered by the turbine rotor.

For example, for purposes of illustration, the components 10 preferably are investment cast to provide an airfoil 12 and the root or platform 14 having a directionally solidified (DS) grain structure comprising columnar grains extending along the longitudinal axis of the airfoil. DS components 10 can be cast in accordance with well known casting procedures where heat is directionally extracted from the melt to effect preferential grain growth in that direction; e.g., as taught in U.S. Pat. No. 3,376,915, the teachings of which are incorporated herein by reference. Other forming techniques, such as directionally recrystallized oxide dispersion strengthened material, fiber reinforced metal matrices, DS eutectic alloys, directional forging or mechanical working, etc., may also be used to form the directional grain structure.

Alternately, the components 10 are investment cast to provide an airfoil 12 having a single crystal grain structure comprising a single grain having a preferred crystallographic orientation; e.g., the <001> crystal directions, generally parallel to the longitudinal axis of the airfoil (plus or minus 15° to the airfoil stacking). Single crystal components 10 can be cast in accordance with well known procedures where a single crystal nucleated in a crystal nucleation or starter region of a casting mold is selected (e.g., by a "pigtail" crystal selector) for propagation through a mold cavity having the configuration of the component 10 as taught in U.S. Pat. No. 4,548,255, the teachings of which are incorporated herein by reference. Other patents relating to single crystal casting include 3,494,709; 3,536,121; 3,542,120; 3,627,015 and 3,690,368.

As is known, such DS or single crystal airfoils 12 exhibit enhanced mechanical properties (e.g., elevated temperature strength, creep resistance and fatigue resistance) in a direction generally parallel (e.g., within ±15°) to the longitudinal axis of the airfoil (also referred to as the stacking axis). A plurality of individual components 10 each having an airfoil 12 may be formed in practicing the invention. Alternately, each component may be formed having several (e.g., two or more) airfoils 12 interconnected by a common root or lug 14 to reduce the number of components that must be assembled to form the turbine rotor.

Typical nickel base superalloy compositions for use in forming the components 10 comprise, in weight %, 0.13% C, 8.5% Cr, 12% W, 9.5% Co, 5% Al, 2% Ti, 0.9% Nb, 0.015% B, 1.85% Hf and the balance Ni (PWA 1422 alloy) for DS components 10 and 10% Cr, 4.15% W, 5.35% Co, 4.9% Al, 1.35% Ti, 12% Ta and the balance Ni (PWA 1480 alloy) for single crystal components 10.

After formation, the components 10 are machined and the appropriate surfaces boronized prior to assembly side-by-side in an annular array as shown in FIGS. 1-2 with a sealing member 40 wherein the first side surface 14b of one component 10 is juxtaposed to the second side surface 14c of the next adjacent component 10 in the array. The annular array of components 10 is concentric to the axis of revolution of the turbine rotor. The first and second side surfaces 14b,14c of the root or lug 14 of each component 10 are formed to stringent dimensional tolerances in order to accurately position the airfoils 12 with respect to the turbine rotor axis of revolution when the components 10 are so assembled. To this end, the side surfaces 14b,14c are typically machined after casting to provide no more than about 0.002 inch gap between the first side surface 14b of one component and the second side surface 14c of the next adjacent component 10 in the annular array during the entire manufacturing operation where melting of boron-bearing material tends to increase the gap.

From FIG. 1, it is apparent that the inner arcuate surfaces 14a of the roots 14 of the components 10 are positioned contiguous with one another so as to define a generally cylindrical plasma spray receiving surface 15 that is adapted to receive the plasma spray deposit in a manner to be described. The inner arcuate surfaces 14a typically are machined prior to assembly of the components 10 in the array to define the spray-receiving surface 15 accurately with respect to the rotor axis of revolution.

After the aforementioned machining operation, the components 10 are subjected to a boronizing operation to apply a boron-bearing melting point depressant material to the inner arcuate surface 14a and typically at least one of the side surfaces 14b,14c (preferably both surfaces 14b,14c) of each component 10. The melting point depressant material is present to form, upon subsequent heating preparatory to plasma spraying, an exposed in-situ liquid phase or layer on the inner surface 14a and to form a gas tight fusion joint between the juxtaposed side surfaces 14b,14c as will be described in detail herebelow. Other melting point depressant materials, such as silicon, may be used in practicing the invention.

The quantity of boron or other melting point depressant material applied to the surfaces 14a,14b,14c will depend on the compositions of the components 10 and the plasma sprayed superalloy involved as well as the temperature of the assembled components 10 prior to spraying. For the aforementioned nickel base superalloys to be heated to about 2000° to 2150° F. immediately prior to plasma spray casting, the boron is applied (as applied by Materials Development Corp., Bedford, Mass.) to the surfaces 14a,14b and/or 14c in the range of about 2 mg/in$^2$ (0.3 mg/cm$^2$) to about 17 mg/in$^2$ (2.6 mg/cm$^2$), preferably about 4 mg/in$^2$ (0.6 mg/cm$^2$) to about 6 mg/in$^2$ (0.9 mg/cm$^2$). In particular, the quantity of boron present and the temperature of the assembled components 10 are selected to generate an exposed in-situ liquid phase or layer at the onset of plasma spraying and fusion bonding of the juxtaposed side surfaces 14b,14c. The liquid phase on the inner surfaces 14a has been found to enhance the metallurgical bond developed between the components and the spray cast deposit. The boron functions as a melting point depressant on surfaces 14a such that heating to the selected temperature effects incipient surface melting and fluxing of the surface 14a. The boron functions as a melting point depressant on surfaces 14b,14c to form gas tight fusion joints at the juxtaposed side surfaces 14b,14c.

The components 10 are assembled in the array on a metal (e.g. IN713C alloy) sealing plate or other member 40 that is disposed adjacent an axial end EE of the array to close off that end, thereby forming a cavity 45 into which molten metal can be plasma sprayed in a manner to be described below.

The axial end 14d of each component 10 is subjected to the aforementioned boronizing operation prior to assembly with the components 10 to form a boron-bearing layer thereon for forming a gas tight fusion joint or bond with the sealing member 40 during the preheating operation described below.

The components 10 and sealing member 40 typically are solvent cleaned (e.g., using 1,1,1-trichlorethane and then Freon solvent) prior to boronizing.

Typically, the components 10 are assembled and held in the annular array on the sealing member 40 using a fixture, FIG. 2, comprising a table or platform 22 and one or more stainless steel fixture rings 24 surrounding the array of components 10. The ring(s) 24 are machined to have an inner diameter that can be placed in snug fit about the array outer diameter (e.g., tap fit wherein the rings 24 are axially tapped into position about the array outer diameter) prior to heating the components 10 to the desired plasma spraying temperature. The rings 24 are adapted to yield as the components 10 are heated by the plasma directed at the inner surfaces 14a and expand radially toward the rings. Any gap developed as the boron-enriched surfaces (14b,14c) melt is eliminated by thermal expansion of the components 10 relative to the rings 24. The boron-enriched surface regions preferably are made as thin as possible to minimize development of such a gap. The invention is not limited to any particular fixturing mechanism described and may be practiced using other fixturing mechanisms.

For example, a fixturing ring (not shown) may be disposed on the table 22 around the airfoils 12 and carry a plurality of radially oriented, spring-biased fixturing pins (not shown) for engaging the outer tips of airfoils 12 to maintain the blade position when the boron-enriched surfaces melt. The fixturing ring and pins may be used in lieu of or in addition to rings 24 shown in FIG. 2. The fixturing ring supporting the fixturing pins would be located far enough from the plasma nozzle 42 that the pin biasing springs would not be overheated. An auxiliary positioning ring (not shown) may be required between the airfoil tips and the fixturing ring to support the fixturing pins. The engagement pressure of the fixturing pins on the airfoils 12 should be controlled to avoid excessive pressure that could cause recrystallization of the grain structure.

The assembled/fixtured components 10/sealing member 40 are placed in a plasma spray chamber 41 where they are preheated preparatory to the plasma spraying using plasma spray nozzle 42. For example, as depicted schematically in FIG. 2, there is provided a plasma spray nozzle 42 for projecting sprayed molten metal (molten superalloy) onto the surfaces 14a (i.e., plasma spray receiving surface 15) and the sealing member 40. Preferably, the molten superalloy is sprayed by means of the introduction of metal powder (e.g., −325 mesh) into a high velocity thermal plasma. Particular success has been experienced using a plasma spray apparatus manufactured by Electro Plasma Inc. of Irvine, Calif. Such an apparatus generates a high temperature plasma of flowing inert gas. Solid superalloy powder is injected into and fully or partially melted by the high temperature plasma and the resulting fully or partially molten droplets/particles are projected, by movement of the plasma, toward the cavity 45 and the spray-receiving surface 15. To insure deposition of the sprayed molten superalloy onto the surface 15, the assembled/fixtured array of components 10/sealing member 40 may be moved and/or the plasma gun indexed in order to impart a configuration to the deposited metal appropriate for the particular application. The spray cast metal is adherent to the surface 15 to form a preform comprising the spray cast metal 11 deposited and incrementally solidified onto the surface 15 and the sealing member 40. The spray cast deposit 11 constitutes a hub precursor of the turbine rotor to be formed. An as-sprayed metallurgical diffusion bond is formed between the surface 15 and the spray cast deposit 11 as well as throughout the spray cast deposit 11.

Typical nickel base superalloys used to form the plasma sprayed hub precursor of the turbine rotor include IN100 comprising, in weight %, 0.17% C, 9.5% Cr, 15% Co, 3% Mo, 5.5% Al, 4.2% Ti, 0.035% Zr, 0.015% B, 1% V and the balance Ni, or LC Astroloy comprising 0.03% C, 15% Cr, 17% Co, 5% Mo, 4% Al, 3.5% Ti, 0.02% B and the balance Ni.

The plasma nozzle 14 typically is in a fixed position with respect to the cavity 45 and the components 10/sealing member 40 are rotated (table 22 is rotated) with respect to the nozzle 14 to deposit the metal 11 within and above the cavity 45 in the appropriate configuration (e.g., to level L). A subsequent hot isostatic pressing operation is used to close any minor voids at the interface, fully densify the deposit 11 and enhance the as-sprayed metallurgical diffusion bond joint between the spray cast deposit 11 and the solid components 10.

Preferably, prior to low pressure, high velocity spray casting in the spray chamber, the assembled components 10/sealing member 40 are preheated in the spray chamber in a controlled, low pressure atmosphere (Ar and He) by impingement with a thermal plasma and the surface 15 is then immediately reverse arc cleaned (RAC'ed) in a thermal plasma. Preheating of the surface 15 affects the rate of heat transfer when the molten metal spray subsequently strikes the surface 15. Because steep thermal gradients between the spray cast deposit 11 and the components 10 can result in residual stresses across their interface, the amount of preheating is controlled to minimize such gradients. For the aforementioned nickel-base alloys, preheating the components 10 to a temperature in the range of from 2000° F. to 2200° F. is preferred. The components 10 can be preheated by means of the thermal plasma or other means (e.g., induction heating) prior to the deposition of the spray cast metal 11, thereby providing an efficient production process capable of being automated.

The reverse arc cleaning process is described in an article Journal of Metals, October 1981, authored by Shankar et al and involves forming a direct current arc with the surface 15 as the cathode. Reverse arch cleaning removes surface impurities when conducted in a controlled atmosphere at low pressure.

The plasma spray chamber 41 is typically first evacuated to about 1–15 microns Hg, and then backfilled to 30–50 torr with Ar and He. The assembled components are then preheated to a desired preheat temperature by impinging a thermal plasma generated by the nozzle 42 on the surface 15. Reverse arc cleaning (RAC is carried out generally by maintaining the arc at about 100–250 amps between the spray nozzle gun (anode) and the surface (cathode) 15 at a chamber pressure in the range of about 30 to about 70 torr. Both preheating and reverse arc cleaning are conducted in the atmosphere of argon and helium. The surface 15 can be preheated and then reverse arc cleaned (RAC) in multiple sequences prior to spray casting. However, only the final reverse arc clean (RAC) step (just prior to the onset of spray casting) should be allowed to form the exposed in-situ molten phase or layer on surface 15. The time of RAC can be used to control cleaning of the surface 15 and uniformity of the molten layer formed.

During the preheating operation, gas tight fusion joints are formed between the juxtaposed side surfaces **14*b*,14*c* by virtue of the presence of the melting point depressant material on at least one of the surfaces 14*b*,14*c*. Moreover, a circumferentially extending gas tight fusion joint is produced between the axial ends 14*d* of the components 10 and the sealing member 40 for the same reason. Those skilled in the art will appreciate that only one of the juxtaposed surfaces 14*b*,14*c* and only one of surfaces 14*d*** and the mating sealing member surface needs to have the melting point depressant material thereon in order to form the gas tight fusion joints.

The molten metal sprayed onto the surface 15 is rapidly solidified because of the temperature differential between the sprayed molten metal and the components 10 even when the components are preheated. This affords the opportunity to control the microstructure of the spray cast metal 11. By controlling the deposition rate onto the solid metal substrate, the gas pressure in the spray chamber, the velocity of the molten metal spray, and the temperature differential between the metal spray and the solid metal substrate, the grain size of the spray cast metal 11 can be varied and controlled. The molten metal solidifies incrementally to the surface 15 and then to the previously deposited solidified spray cast metal 11 to build up the spray cast metal deposit on the surface 15.

The spray cast metal 11 is subsequently rendered fully dense with a desired fine grain size (e.g., in the range of from ASTM 4 to ASTM 10) by appropriate thermal treatments. This grain size range generally meets the grain size requirements of the hub of turbine engine rotors.

In particular, the preform thusly formed (i.e., the spray cast metal 11 on the components 10) is hot isostatically pressed to virtually eliminate any voids in the spray cast metal 11 and enhance metallurgical diffusion bonding between the spray cast metal 1; and the surface 15. Hot isostatic pressing is preferably conducted in such a manner as to promote epitaxial grain growth across the interfacial bond region between the surface 15 and the spray cast metal 11. As is well known, hot isostatic pressing is carried out under gas pressure thereby applying an isostatic pressure on the preform. After consolidation of the preform by hot isostatic pressing, the preform can be heat treated to obtain the desired mechanical properties for both the spray cast metal 11 and the components 10.

The process of the invention includes the formation during the final stages of spray casting of a gas impervious layer on the outermost surface 11b (i.e., uppermost surface in FIG. 3) of the spray cast metal 11 to allow removal of residual microporosity by the subsequent hot isostatic pressing treatment. The gas impervious layer provides a means of transmitting the gas pressure during hot isostatic pressing to densify the spray cast metal 11 and eliminate any residual voids therein. Moreover, there will be a gas impervious bond between the outer exposed edge 11a of the spray cast metal 11, FIG. 3, and the surface 15 shown so that gas pressure applied during hot isostatic pressing does not infiltrate to the interfacial region between the spray cast metal 11 and the surface 15.

In general, the present invention is practiced with isostatic pressures of 15 to 25 KSI at temperatures of between about 1950° F. to about 2250° F. for about 2 to about 4 hours when the components 10 and the spray cast metal are nickel base superalloys typical of those described hereinabove.

An optional heat treatment may be conducted after the hot isostatic pressing operation, if needed, to diffuse boron away from the gas tight fusion joints at surfaces 14b,14c. The temperature of the heat treatment will depend upon the superalloy composition involved. A temperature of about 2200° F. but less than the melting temperature of the superalloy may be used for typical nickel base superalloys.

The hot isostatically pressed preform is typically heat treated further to develop desired mechanical properties.

An illustrative preheating and plasma spraying procedure for practicing the invention when the components 10 comprise the PWA 1480 alloy described above and the plasma spray superalloy comprises LC Astroloy (0.03 w/o C, 15 w/o Cr, 17 w/o Co, 5 w/o Mo, 4 w/o Al, 3.5 w/o Ti and 0.020 w/o B where w/o is weight %)is now set forth for purposes of illustration, but not limitation.

Prior to plasma spraying, the assembled/fixtured components 10/sealing member 40 are low pressure plasma preheated (LPP) with the plasma gun at a chamber pressure of about 40 torr (Ar and He) with a gun power of approximately 70 KW until a surface temperature of 1000° F. is observed as indicated by the pyrometer. Then, the preheated assembly is low temperature reverse arc cleaned (LT RAC) at 1000° F. at about 125 amps until clean. No molten layer is formed on surface 15 during the LT RAC.

The LPP preheat is continued at 50 torr until the temperature of the surface 15 is about 2160° F. At about 2160° F., a high temperature reverse arc clean (HT RAC) is initiated. The HT RAC is maintained until the surface 15 is observed to be clean (e.g., substantially free of any oxides formed during preheating) and a uniform molten surface layer is observed thereon. The RT RAC treatment provides the required surface energy input to clean the surface 15 and to melt the boronized surface layer thereon.

The HT RAC is turned off and the powder feeding into the existing plasma plume is immediately started to impinge fully molten droplets on the molten surface 15 and the sealing member 40 with a spray chamber pressure of about 10 microns or less. A zero time lag between HT RAC "off" and powder feed "on" is desired.

Following plasma spraying, the spray cast preform is cooled under vacuum of less than 10 microns. The chamber is then argon backfilled to ambient atmosphere prior to removal of the preform.

After cooling and removal from the plasma spray chamber, the spray cast preform is hot isostatically pressed at 2165° F. and 25 KSI for 4 hours. The gas tight fusion joints formed between the juxtaposed side surfaces 14b,14c and between the axial ends 14d and the sealing member 40 during the preheating step prevent the Ar pressurizing gas from penetrating between the joints to enable effective hot isostatic pressing of the preform.

Following hot isostatic pressing, the sealing member 40 is removed from the preform by conventional machining methods to the customer-specified contour, usually for ultrasonic inspection. The sealing member 40 should be completely removed from the preform.

Thereafter, the preform is heat treated as follows: 2360° F. for 2 hours/AC (air cool)+1600° F. for 8 hours/AC+1800° F. 4 hours/AC+1200° F. for 24 hours/AC+1400° F. for 8 hours/AC to ambient to develop mechanical properties. The spray cast deposit 11 also can be machined after heat treatment to the final configuration and dimensions for the hub of the turbine rotor. The components 10 can be solution treated (i.e., heated to an appropriate solutioning temperature; e.g., 2360° F. for PWA 1480) prior to deposition of the spray cast deposit 11 thereabout.

The method of the invention is advantageous in that it permits DS or single crystal blade components 10 having enhanced mechanical properties in the radial direction to b fabricated by conventional procedures and then bonded together with one another and with the spray cast deposit 11 to form a dual alloy turbine rotor wherein the spray cast deposit 11 constitutes the rotor hub and exhibits mechanical properties appropriate for the hub.

Although the invention has been shown and described with respect to a certain embodiments thereof, it will be understood by those skilled in the art that various changes in form and detail thereof may be made without departing from the spirit and scope of the claimed invention.

I claim:

1. A method of making a dual property article, comprising the steps of:

a) forming a plurality of metallic components each having an inner surface and first and second side surfaces, b) arranging the components side-by-side in an annular array with the first side surface of one component juxtaposed to the second side surface of an adjacent component with a melting point depressant material on the inner surfaces and between the side surfaces and with the inner surfaces defining a spray-receiving surface, c) heating the array to form an exposed liquid layer on the spray-receiving surface at the onset of plasma spraying of a molten metal thereon and a gas tight fusion joint between the juxtaposed first and second surfaces of said components, d) plasma spraying the molten metal onto the exposed liquid layer to build-up a deposit, and e) hot isostatically pressing the array/deposit.

2. The method of claim 1 including positioning a sealing member adjacent an axial end of the array of said components to close off said end, including providing a melting point depressant material between said sealing member and said end of the array, whereby a gas tight fusion joint is formed between the sealing member and the end of the array in step d).

3. The method of claim 2 including removing the sealing member after hot isostatic pressing.

4. The method of claim 1 wherein the components are formed to have a directionally solidified grain structure comprising columnar grains.

5. The method of claim 4 wherein in step b), the components are arranged so that the columnar grains extend along a radial axis of the article.

6. The method of claim 1 wherein the components are cast to have a single crystal grain structure.

7. The method of claim 6 wherein in step b), the components are arranged so that a given crystallographic axis of said single crystal grain structure extends along a radial axis of the article.

8. The method of claim 1 wherein the inner surface and one of said first and second sides are coated with a boron-bearing melting point depressant material.

9. The method of claim 1 wherein the components are held in the array by fixturing means.

10. A method of making a dual alloy article, comprising the steps of:

a) forming a plurality of metallic components each having an inner surface and first and second side surfaces, b) arranging the components side-by-side in an annular array with the first side surface of one component juxtaposed to the second side surface of an adjacent component with a melting point depressant material on the inner surfaces and between the side surfaces and with the inner surfaces defining a spray-receiving surface, c) positioning a sealing member adjacent an axial end of the array of said components to close off said end and form a cavity, including providing a melting point depressant material between said sealing member and said end of the array, d) heating the array to form an exposed liquid layer on the spray-receiving surface at the onset of plasma spraying of a molten metal thereon having a composition different from that of said components and to form a gas tight fusion joint between the juxtaposed first and second surfaces of said components and between the sealing member and said end of the array, e) plasma spraying the molten metal onto the exposed liquid layer to build-up a deposit in the cavity, and f) hot isostatically pressing the array/deposit.

11. The method of claim 11 including removing the sealing member after hot isostatic pressing.

12. The method of claim 10 wherein the components are formed to have a directionally solidified grain structure comprising columnar grains.

13. The method of claim 12 wherein in step b), the components are arranged so that the columnar grains extend along a radial axis of the article.

14. The method of claim 10 wherein the components are cast to have a single crystal grain structure.

15. The method of claim 14 wherein in step b), the components are arranged so that a given crystallographic axis of said single crystal grain structure extends along a radial axis of the article.

16. The method of claim 10 wherein the inner surface and one of said first and second sides are coated with a boron-bearing melting point depressant.

17. The method of claim 10 wherein the components are held in the array by fixturing means.

18. A method of making a dual alloy gas turbine rotor, comprising the steps of:

a) forming a plurality of superalloy components each having an inner surface and first and second side surfaces, said components each including an elongated airfoil having one of a directionally solidified columnar grain structure and a single crystal grain structure along a longitudinal axis thereof, b) arranging the components side-by-side in an annular array with the first side surface of one component juxtaposed to the second side surface of an adjacent component with a melting point depressant material on the inner surfaces and between the side surfaces and with the inner surfaces substantially contiguous to define a circumferentially extending spray-receiving surface, said airfoils being oriented to extend in a radial direction, c) positioning a sealing member adjacent an axial end of the array of said components to close off said end and form a cavity, including providing a melting point depressant material between said sealing member and said end of the array, d) heating the array to form an exposed liquid layer on the spray-receiving surface at the onset of plasma spraying of another superalloy thereon and to form a gas tight fusion joint between the juxtaposed first and second surfaces of said components and between the sealing member and the end of the array, e) plasma spraying said another superalloy on the exposed liquid layer to build-up a deposit in said cavity to form a hub precursor of said rotor, and f) hot isostatically pressing the array/deposit.

19. The method of claim 18 including removing the sealing member after hot isostatic pressing.

20. The method of claim 18 wherein the inner surface and one of said first and second sides are coated with a boron-bearing melting point depressant.

21. A dual property article made by the method of claim 1.

22. A dual alloy article made by the method of claim 10.

23. A dual alloy turbine rotor made by the method of claim 18.

* * * * *